United States Patent [19]

Comfort

[11] Patent Number: 5,052,327

[45] Date of Patent: Oct. 1, 1991

[54] INBOARD/OUTBOARD AND OUTBOARD GUIDING SAFETY DEVICE AND METHOD

[76] Inventor: Forrest Comfort, R.D. #5, Box 139A, Tuckahoe Rd., Williamstown, N.J. 08094

[21] Appl. No.: 554,444

[22] Filed: Jul. 19, 1990

[51] Int. Cl.[5] ..... B63B 49/00

[52] U.S. Cl. ..... 116/26; 116/31; 116/28 R; 116/173; 440/2; 440/900

[58] Field of Search ..... 116/28 R, 31, 173-175; 40/600; 33/264; 248/206.5; 440/2, 900

[56] References Cited

U.S. PATENT DOCUMENTS

| | | | |
|---|---|---|---|
| 1,362,428 | 12/1920 | Luck | 116/31 |
| 1,524,722 | 2/1925 | Sheffel | 116/31 |
| 3,015,162 | 1/1962 | Bohnet | 33/264 |
| 3,241,516 | 3/1966 | Hopkins | 116/173 |
| 3,331,350 | 7/1967 | Norton | 116/31 |
| 3,601,082 | 8/1971 | Wise | 116/114 |
| 3,858,966 | 1/1975 | Lowell, Jr. | 116/28 R |
| 4,621,432 | 11/1986 | Law | 33/264 |
| 4,666,176 | 5/1987 | Sand | 280/477 |
| 4,700,655 | 10/1987 | Kirby | 116/174 |
| 4,708,359 | 11/1987 | Davenport | 280/477 |

FOREIGN PATENT DOCUMENTS

| | | | |
|---|---|---|---|
| 0196696 | 8/1988 | Japan | 440/2 |

*Primary Examiner*—William A. Cuchlinski, Jr.
*Assistant Examiner*—W. Morris Worth
*Attorney, Agent, or Firm*—Thomas A. Lennox

[57] ABSTRACT

A directional guidance device is provided for use on pleasure boats to indicate the direction of propeller thrust of an outboard motor or inboard/outboard steerable mechanism that are hidden from the view of the pilot by the transom during docking. The device includes an upright member with a rigged directional flag member pointing in the direction of thrust with an attachment device at the lower end of the upright member to attach and detach the device to the top of or to the top of the inboard/outboard steerable propeller.

9 Claims, 5 Drawing Sheets

INBOARD/OUTBOARD AND OUTBOARD GUIDING SAFETY DEVICE AND METHOD

BACKGROUND OF THE INVENTION

This invention involves a guidance device to indicate the direction of thrust of either an inboard/outboard propeller system or of an outboard motor on the rear of a pleasure boat.

This invention further relates to boats with motors extending from an inboard/outboard system out from the stern of the boat or outboard motors.

Inboard/outboard motor powered boats are systems where motors are located inside the hull of the boat but mechanisms extend outwardly through the stern with a gear drive angled downwardly with the mechanism rotatable horizontally to steer the boat. The invention is also related to and is used on outboard motors which are fixed to the stern of the boat. The invention is useful on a single outboard motor or on a plurality of outboard motors fixed to an extension extending outwardly from the stern of the boat. For many boat constructions, the engine housing of the outboard motor and the gear drive of the inboard/outboard motor or the gear drive propeller extension of the inboard/outboard motor are both well below the top edge of the transom in the stern of the boat. The line of sight from the driving position of the boat in many instances does not allow the boat operator to be able to see the top of the housings. These tops are hidden below line of sight by the transom in the stern of the boat. The problem of the outboard motor being outside the line of sight of the operator is particularly acute on house boats and pontoon boats. This inability to see the motor or the propeller mechanism is not important in the open water as only minor adjustments are necessary to change the course of the boat and the feel of the wheel and the coarse of the boat are more than sufficient to allow close control.

On the other hand, as the boat is slowed and is approaching the dock, it is many times necessary to turn the motor thrust fully to one side or the other either to move the stern toward the dock or away from the dock. Further, as the boat is leaving the dock, it is almost always necessary to turn the motor thrust to a severe angle in order to avoid the dock and other boats moored in close proximity. Many persons have a great deal of difficulty moving the boat at this low speed and sometimes get confused as to the direction the motor thrust is pointed. This can cause the boat to strike the dock or other boats in the area. Once having made the error and powered the boat in the wrong direction, there are many circumstances where it is not possible to stop the boat by completely reversing the direction of the motor thrust quickly enough to avoid at least a close encounter.

Devices have been provided of a mechanical or electronic nature to provide the motor thrusting direction on the dashboard, but these devices are expensive, and tend to have mechanical or electronical failures in due course. None of the prior art devices satisfy the need described hereinabove nor attain the object described hereinbelow.

SUMMARY OF THE INVENTION

It is an object of the present invention to provide a guidance device that will assuredly indicate the direction of thrust of the propellers where the two mechanisms are out of sight of the boat pilot.

It is an additional object of the present invention to provide a directional guidance system indicating the direction of thrust of the inboard/outboard motors that can be easily attached when getting ready to leave the dock and disattached as soon as the dock area is cleared, as well as being reattached when the boat nears the dock in order to tie up again.

It is a further object of the invention to provide directional guidance device indicating the direction of thrust of the motors wherein the direction indicated by the guidance device will assuredly be either in the direction of thrust or in the direction away from the thrust.

An aspect of the invention is a thrust directional guidance device for attachment to an inboard propeller and steering mechanism or an outboard motor, either being fixed to the stern of a boat with a top of the transom at the stern of the boat that obscures the line of sight from a piloting position to the uppermost portion of the inboard propeller and steering mechanism or of the outboard motor. The device includes an upright member of sufficient length to extend from a lower end at a height proximate housing of the inboard propeller and steering mechanism or of the outboard motor to an upper end to a height above transom of the boat. The device further includes flag means fixed to the upper end of the rod member to visually indicate a single direction. The device also includes attachment means to releasably attach the lower end of the rod member to the housing of the inboard propeller and steering mechanism or of the outboard motor. The device further includes adjustment means to assure that the direction indicated by the flag means is either in the direction of thrust of the propeller of the inboard or outboard motor or in the opposite direction.

It is preferred that the device further include a direction adjustments means to adjust the direction of the flag means after the device is attached to the housing of the inboard propeller and steering mechanism or of the outboard motor. It is further preferred that the direction adjustment means include a break along the length of the upright member with engagement means to releasably reconnect the parts of the up right member in any chosen horizontal angle with respect to each other. It is also preferred that the flag means include a rigid member of visibly colors polymeric plastic. It is further preferred that the flag means include a rigid member that includes two upright vertical surfaces facing in opposite directions that are normal to the direction the flag means is indicating, both surfaces having reflective surfaces. It is also preferred that the flag means include a rigid member comprising two upright vertical surfaces facing in opposite directions normal to the direction the flag means is indicating, the surfaces being of colors visually distinguishable from each other. It is further preferred that the attachment means include a magnet attached to lower end of the upright member and a magnetically attracted member attached to the housing of the inboard propeller and steering mechanism or of the outboard motor. It is also preferred that the adjustment means include means that positions the horizontal alignment of the magnet with respect to the magnetically attracted member on the housing of the inboard propeller and steering mechanism or of the outboard motor. It is further preferred that the adjustment means include attachment means that fixes the horizontal alignment between lower end of the upright member and the housing of the inboard propeller and steering mechanism or of the outboard motor.

It is preferred that the attachment means include an integral formable metal bracket that includes the magnetically attracted member a centrally positioned plate, a plurality of arms radially extending from the plate, and arm attachment means to fix the arms to the top of the housing of the inboard propeller and steering mechanism or of the outboard motor.

Another aspect of the invention is a method of docking a boat equipped with an inboard/outboard propeller and steering mechanism or an outboard motor fixed to the stern of the boat wherein the top of the transom at the stern of the boat obscures the line of sight from a piloting position to the uppermost portion of the inboard/outboard propeller and steering mechanism or of the outboard motor. The method includes reducing the speed of the boat as it approaches the dock, and providing a thrust directional guidance device that includes an upright member of sufficient length to extend from a lower end at a height proximate housings of the inboard/outboard propeller and steering mechanism or of the outboard motor to an upper end to a height above transom of the boat, and flag means fixed to the upper end of the rod member to visually indicate a single direction. The method further includes releasably attaching the lower end of the rod member to the housing of the inboard propeller and steering mechanism or of the outboard motor, and adjusting the direction indicated by the flag either in the direction of thrust of the propeller of the inboard or outboard motor or in the opposite direction. The method further includes that while steering the boat that the pilot observe the direction indicated by the flag means to know the direction of the propeller thrust.

It is preferred that the attaching include providing a magnet attached to the lower end of the upright member and a magnetically attracted member attached to the top of the housing of the inboard propeller and steering mechanism or of the outboard motor and that the adjusting include positioning the horizontal alignment of the magnet into aligning means on the magnetically attracted member. It is further preferred that the adjusting include attaching the lower end of the rod and fixing the horizontal alignment between lower end of the upright member and the housing of the inboard propeller and steering mechanism or of the outboard motor. It is also preferred that the attaching of the lower end of the rod including providing an integral formable metal bracket that includes the magnetically attracted member a centrally positioned plate, and a plurality of arms radially extending from the plate. The attaching further includes forming the arms to align with bolts through the top of the housing of the inboard propeller and steering mechanism or of the outboard motor, drilling holes through the arms to align with the bolts, and attaching the arms with the bolts through the holes to the top of the housing of the inboard propeller and steering mechanism or of the outboard motor.

DESCRIPTION OF PREFERRED EMBODIMENTS

Figure 1:
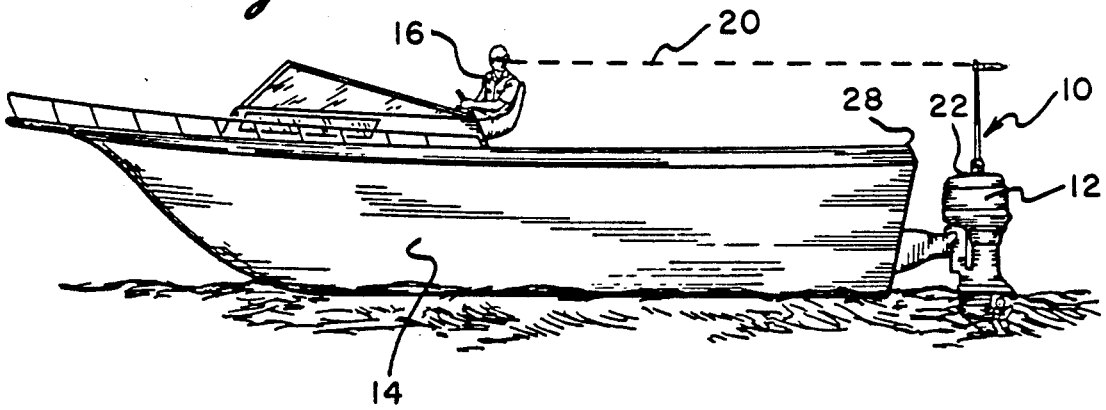
FIG. 1 is a side elevational view of a pleasure boat to which a device of the present invention has been attached to the outboard motor.
Figure 10:
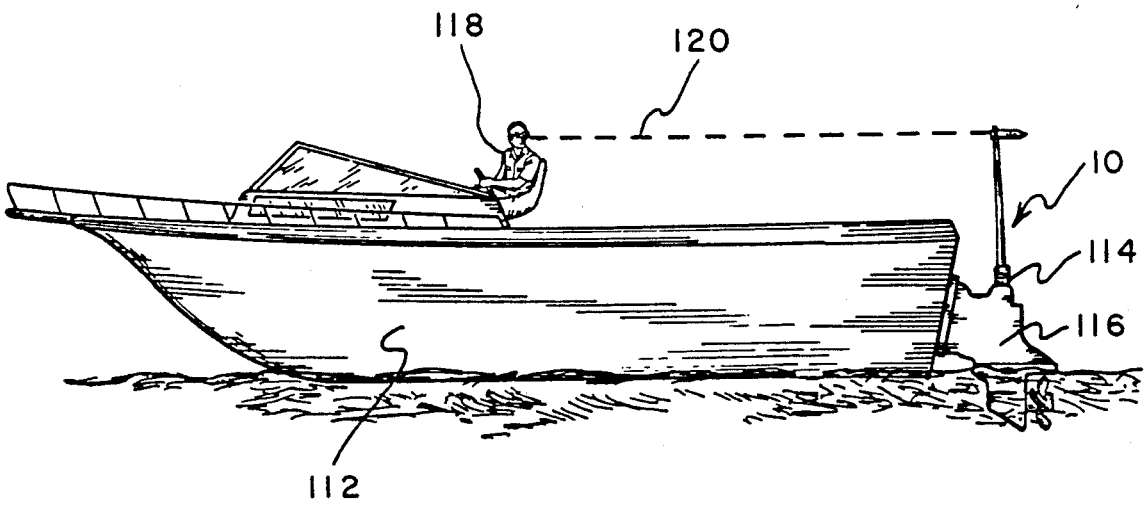
FIG. 10 is a side elevational view of a pleasure boat to which a device of the present invention has been attached to the inboard/outboard propeller and steering mechanism.

In FIG. 1, guidance device 10 is attached to top of motor housing 22 of outboard motor 12 which is attached to and powers boat 14. Pilot 16 is seated at driving location 18 slightly forward of the midpoint of the boat commonly about eight to twenty feet from the motor. When seated at driving location 18, the pilot's line of sight is blocked by top of transom 28 such that the pilot cannot see the top of housing 22. On the other hand, the flag device at the top of guidance device 10 can readily be observed along line of sight 20, as it extends well above top of transom 28. As will readily be observed from this drawing, inboard/outboard motor powered boat 112 illustrated in FIG. 10 which has shaft and propeller extending through a gear mechanism 116 outwardly and downwardly from the transom of the boat with the capability of steering the boat by turning that gear mechanism, suffers from the same problem as illustrated in FIG. 1. In that situation, the only difference is that device 10 is fixed to the top 114 of the housing of the gear mechanism which turns in response to a cable assembly attached to a steering wheel in the same fashion as illustrated in FIG. 1. Line of sight 120 from operator 118 to the flag of device 10 is not obstructed.

Figure 2:
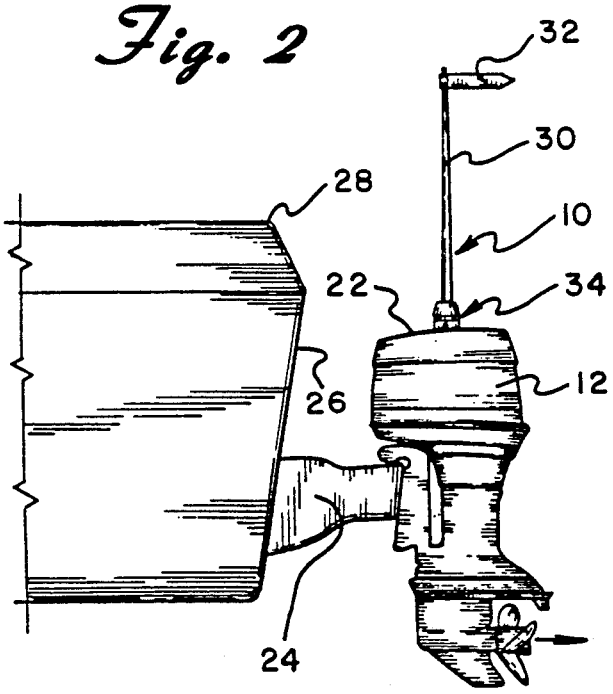
FIG. 2 is a partial cut away expanded elevational view of the rear of the boat, outboard motor and a device of the present invention as illustrated in FIG. 1.
Figure 3:
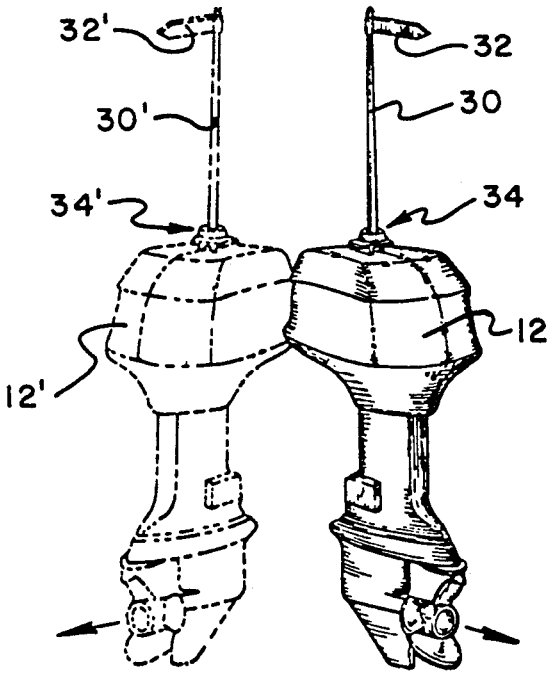
FIG. 3 is a perspective view of an outboard motor as illustrated in FIGS. 1 and 2 with the device of the present invention illustrated in FIGS. 1 and 2 attached on the top showing the thrust direction, together with a shadow view of the engine turned to a new direction with the device continuing to point the thrust direction.

In FIG. 2, device 10 is shown in larger scale attached to outboard motor 12 with the direction of thrust indicated by the arrow. For the purposes of specification and claims, the direction of thrust is indicating the thrust of the propeller against the water as opposed to the opposite of the motor and the boat cause by the action of the propeller thrust against the water. Outboard motor 12 is attached to transom 26 at the stern of the boat by connection to motor attachment panel 24 which is a generally horizontal structural extension attached to the bottom section of transom 26. Device 10 includes flag member 32 which is attached at the upper end to rod member 30 which is attached at its lower end through attachment device 34 to housing 22. Flag member 22 is shown as a rigged polymeric plastic pointer which may be constructed of transparent red polymethyl methacrylate plastic molding material, having an internal reflectance either by incorporating a reflecting layer in the molding or by incorporating reflecting facets on an interior surface to reflect the light much in the way a rear automobile reflector is constructed. Flag member 32 has a pointed free end indicating direction of thrust. Alternative embodiments could employ differing elements to indicate direction. These elements could be two different colors on opposite side of flag member 32. The particular colors are not critical, as it is only necessary to be able to distinguish from the sides and assure that the pilot is able to easily discern the direction the motor thrust is pointed. As shown is FIG. 3, motor 12 is shown at angled in one direction, with direction of thrust to the right of the viewer and in a shadow view motor 12' has turned to a new angle with direction of thrust to the left. In the process of angling the motor attachment device 34 which rigidly holds rod member 30' is angled and flag member 32' is pointed in the new direction of thrust. In this fashion, pilot 16 can view the direction of thrust by a glance to the rear. Rod member 30 is constructed of an aluminum rod which is tapered from the bottom to top. However, tapering is not required and standard extruding aluminum rod one quarter inch thick is sufficient. Further, an extruding plastic rod or tubing either unreinforced or reinforced by fiberglass provides satisfactory service. As with all components of device 10, it is important to choose materials or provide protective coatings that resist corrosion of water and particularly salt water. Since, the device will be used only at low speeds, the device is subjected to minimal stress in actual operation. Durability of the device is more strongly tested when it is removed from service and is inadvertently laid at the bottom of the boat. It is best practice to provide a location where the device can be stored during the operation of the boat and after the boat is docked, to be removed and used only during the docking or leaving the dock procedures.

Figure 4:
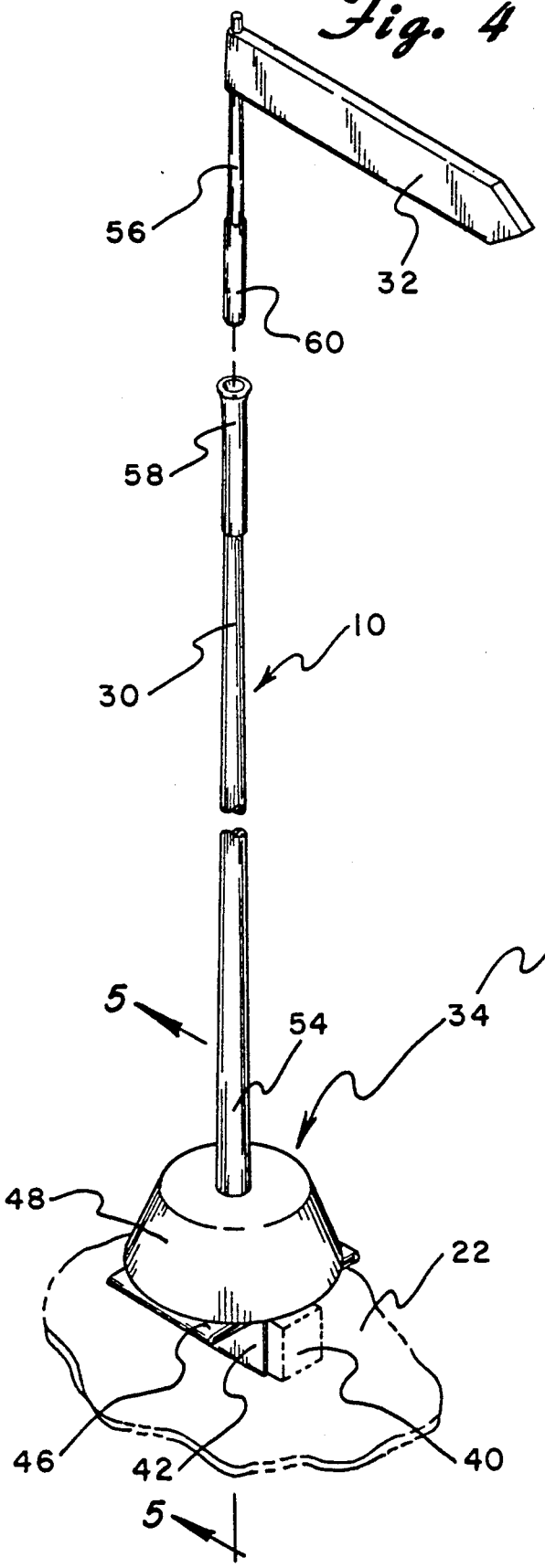
FIG. 4 is a partially exploded perspective view of the device illustrated in FIGS. 1 through 3.

In FIG. 4, an enlarged exploded view of guidance device 10 is shown attached to top of housing 22. As will be clear, the exact structure of flag member 32 is not critical as long as the direction it is pointing is clearly visible to the pilot from a distance of 10 to 20 feet. Further, it is not critical whether flag member 32 points in the direction of thrust or in the opposite direction of thrust, that being the choice of the pilot. Since the device will be attached to the top of the motor, only at the time of most speed when the boat is close to docking or leaving the dock area there is little wind force placed on flag member 32 as a result of boat movement. It is preferred that the flag member point in the direction of motor propeller thrust which is generally to the rear as that appears to be the most consistent way to use the device. It should also be apparent that flag member 32 may be internally illuminated by including a lamp either in flag member 32 or proximate to it in the upper section of rod member 30 powered by a battery which may be connected by a wire to any location in device 10. In this way, the direction of the motor's thrust will be readily visible at night. However, since it is normal and required by law to have lights located at the stern of the boat, flag member 32 is normally visible in any case, either by the lights of the boat or from lights at the docks as most marinas are well lit. Again, for that reason it is preferred that reflective surfaces be on both sides of flag member 32.

Figure 5:
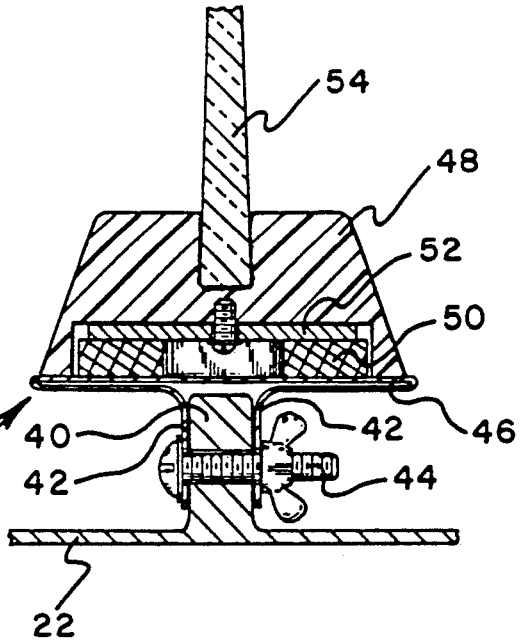
FIG. 5 is a partial sectional view taken along lines 5—5 of FIG. 4.

In FIGS. 4 and 5, attachment device 34 is illustrated in greater detail. It is common on the top of motor housings such as top 22 for a ridge or flange such as flange 42 to extend upwardly a sufficient distance to receive inverted "U" shaped bracket 42 which is attached by bolt and nut combination 44 extending through a hole in flange 40 and through aligned horizontal holes in bracket 42 to attachment plate 46 in a horizontal position to the top of housing 22. Attachment plate 46 is constructed of ferrous metal that is magnetically attractable and covered with a water/weather resistant coating. Magnet housing 48 is attached at lower end 54 of rod 30 and houses torodial shaped magnet 50 which is positioned horizontally on the bottom surface of housing 48. Magnet 50 is connected magnetically to conductive plate 52 which is a disc shaped steel member abutting the upper surface of magnet 50 and sandwiched between the magnet and housing 48. In this fashion, when housing 48 is brought into close proximity with plate 46, the bottom surface of magnet 50 is strongly attracted to and immediately attaches to the top of plate 46 securing and positioning rod 30 in an upright position. In a median section of rod 30 a break is provided with one of the ends terminating with a female, tubular connector 58 extending upwardly from the lower end of the break and opening upwardly to receive male tapered member 60 extending downwardly from upper end 56 of rod 30 fitting connection with connecting 58. Flag member 32 is attached to the upper end of upper section 56. In this fashion, should magnet 50 attach to plate 46 such that flag member 32 is not quite pointing in the correct direction, male connection member 60 may be removed from tubular connector 58 to realign the flag and reconnect so that the flag points in the right direction of motor thrust.

Figure 6:
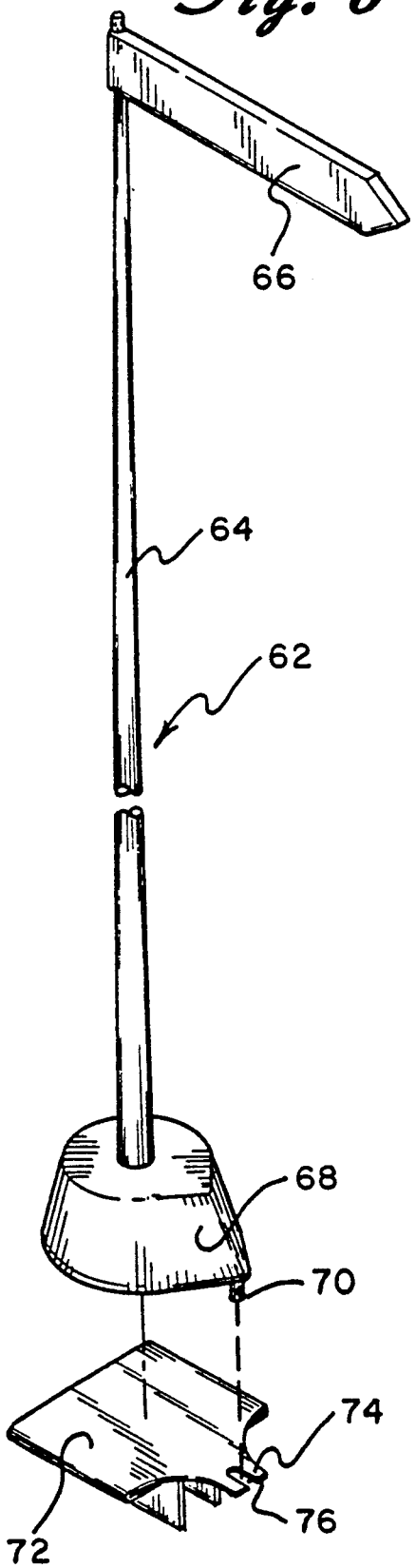
FIG. 6 is a perspective view of a second embodiment of a device of the present invention.
Figure 7:
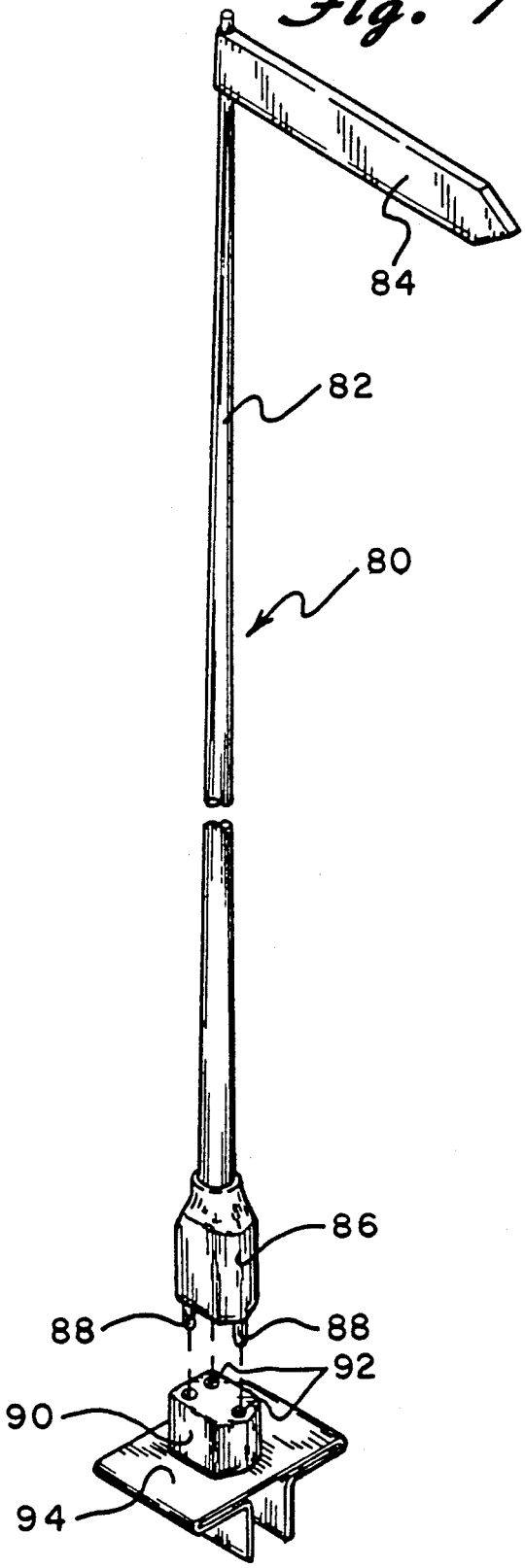
FIG. 7 is a partially exploded view of a third embodiment of a device of the present invention.

In FIGS. 6 and 7, second and third embodiments, respectively, are illustrated wherein attachment of the attachment devices to the top of the motor housing automatically positions the flag member in the chosen direction. With these embodiments there is no need to make any adjustment in the horizontal angle of direction of the flag. In FIG. 6, guidance device 62 includes vertical rod 64 on which flag member 66 is rigidly attached. At the bottom end of rod 64 magnet housing 68 is structurally attached having projection 70 depending downwardly from an outside edge. The magnet inside housing 68 is magnetically attracted and is attached to attachment plate 72 which is similar in construction to that of plate 46, except that it includes extension 74 extending horizontally outwardly from plate 72 with notch 76 cut out to receive depending projection 70 when the magnet is attached to plate 72. In this fashion, the direction of flag member 66 is fixed by the positioning of plate 72 and no adjustment for the direction of flag 66 is necessary. In FIG. 7, guidance device 80 is similar in construction to devices 10 and 62 with vertical rod 82 terminating at its upper end with flag member 84, which again is fixed into position. At the bottom end of rod member 82 is elastomeric rubber housing 86 from which three rigid male projections 88 depend downwardly to interfit into complimentary aligned three holes 92 in lower attachment housing 90. This connection is similar in construction to that of a common three pronged electrical connection plugs and may be used to conduct a current to illuminated flag member 84 with a battery (not shown) located in the lower housing 90, which is permanently attached to attachment panel 94, which is attached in a similar fashion to the prior devices to the top of motor housing 22. The construction of the male and female connection of the lower end of rod 82 fixes the direction of flag member 84.

Figure 8:
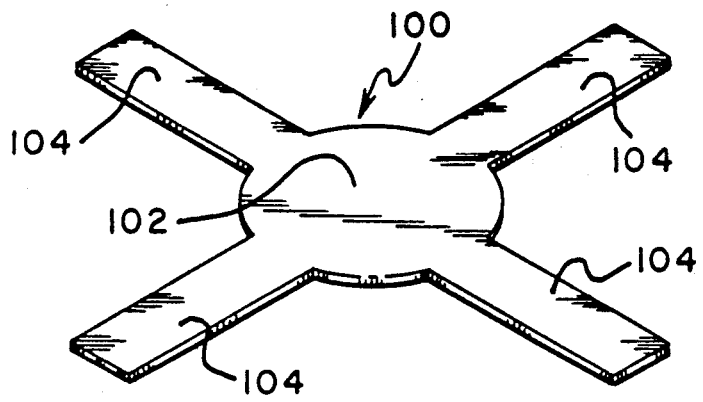
FIG. 8 is a perspective view of a flattened attachment member.
Figure 9:
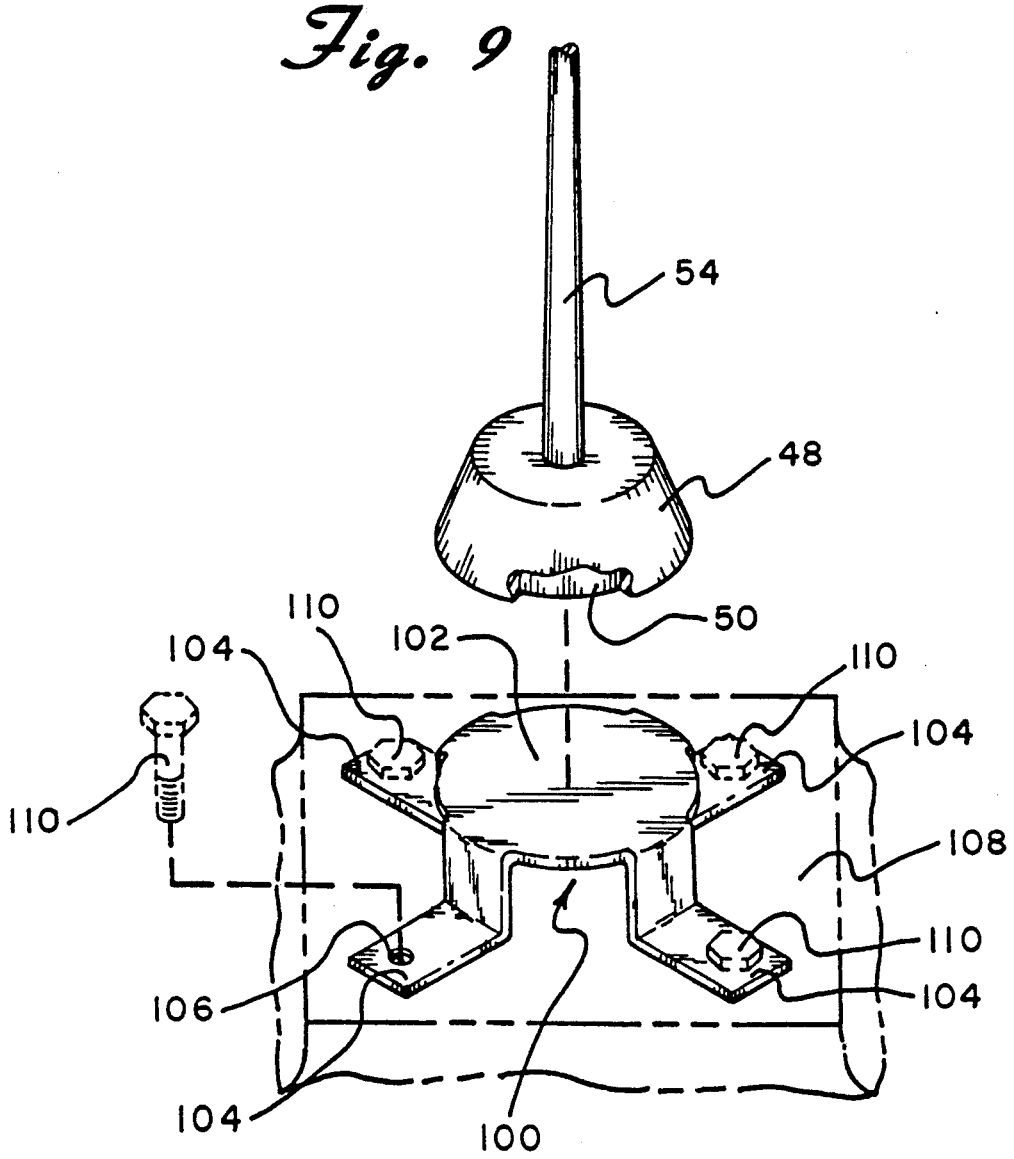
FIG. 9 is an exploded perspective view of a fourth embodiment of the present invention using a formed attachment member shown in FIG. 8.

As illustrated in FIG. 9, the lower attachment end of device 10 is shown in the exploded view as attachable to inboard/outboard propeller mechanism extending outwardly from the transom of the boat. Typical plates, such as top plate 108, on the top of inboard/outboard propeller and steering mechanisms provide two to four bolts 110 about 4 to 6 inches apart. Adapter device 100 can easily be used to connect the flat panel 102 in such a position such that device 10 may be attached. Housing 48, attached to bottom end 54 of rod 30 houses magnet 50 which attaches to horizontal plate 102 of attachment device 100. This attachment device is essentially a one eighth inch thick integral steel member with four radial arms 104 extending outwardly from center plate 102 in the same plane. Arms 104 are bendable and formable to mate with various configurations on the upper portion of the inboard/outboard mechanisms. Holes 106 are drilled through each arm 104 to complimentary mate with bolts 110 threadably engaged through plate 108 of the inboard/outboard mechanism. The position of the bolts through upper plates of various inboard/outboard mechanisms vary somewhat and in FIG. 8, a blank attachment device 100 is illustrated wherein arms 104 can be forcibly bent into various angles and shapes to match the bolt configuration of the particular inboard/-outboard device involved. On some inboard/outboard steering and propeller mechanisms plate 108 is not necessarily positioned horizontally either as a result of the construction of the device or of the particular tilt chosen by the boat owner of the propeller mechanism. Under such circumstances, arms 104 may be bent to provide differing vertical displacements to place center section 102 in a horizontal position. It is common to have vertical projections extend upwardly from plate 108 so that it is generally necessary to make a reverse bend in arms 104 to hold plate 102 at a height above the surface of plate 108. It is, of course, quite satisfactory to have rod 30 of device 10 angled slightly from the vertical as all that is required is to position the directional element within this line of sight of the boat operator.

Although it is not pictured, a safety device to prevent inadvertent loss of the guiding device overboard and in particular to avoid device dropping off the boat and becoming entangled in the motor, can be provided. A simple safety device includes a cord attached to the guidance device which can be secured to the stern of the boat. The length of the cord is chosen to allow the device to be attached to the motor, but be short enough to prevent it from reaching the propeller. In addition, it is preferred that the rod be fiberglass reinforced plastic or a plastic that will shatter upon coming into contact with the propeller. This construction would prevent the device from possibly fouling the propeller.

While this invention has been described with reference to the specific embodiments disclosed herein, it is not confined to the details set forth and the patent is intended to include modifications and changes which may come within and extend from the following claims.

I claim:

1. A thrust directional guidance device for attachment to an apparatus chosen from a group consisting of an inboard/outboard propeller and steering mechanism and an outboard motor mechanism fixed to a stern of a boat, each mechanism having a thrust vector, the boat comprising a top of a transom at the stern of the boat that obscures a line of sight from a piloting position of the boat to an uppermost portion of the inboard/outboard propeller and steering mechanism or of the outboard motor, the device comprising:

(a) an upright member comprising an upper end and a lower end, the upright member being of sufficient length to extend from the lower end at a height proximate housings of the inboard/outboard propeller and steering mechanism or of the outboard motor to the upper end to a height above the transom of the boat.

(b) flag means fixed to the upper end of the upright member to visually indicate a single direction, (c) attachment means to releasably attach the lower end of the upright member to the housing of the inboard propeller and steering mechanism or of the outboard motor, and (d) adjustment means to fix the horizontal alignment between the lower end of the upright member and the housing of the inboard propeller and steering mechanism or of the outboard motor to assure that the single direction indicated by the flag means is either in the direction of the thrust vector or in a direction opposite to that of the thrust vector wherein the attachment means comprises a magnet attached to lower end of the upright member and a magnetically attracted member attached to the housing of the inboard propeller and steering mechanism or of the outboard motor, and wherein the adjustment means positions the horizontal alignment of the magnet with respect to the magnetically attracted member on the housing of the inboard propeller and steering mechanism or of the outboard motor.

2. The device of claim 1 wherein the device further comprises a direction adjustment means to adjust the direction of the flag means after the device is attached to the housing of the inboard propeller and steering mechanism or of the outboard motor.

3. The device of claim 2 wherein the direction adjustment means comprises a break along the length of the upright member dividing it into two parts with engagement means to releasably reconnect the parts of the upright member in any chosen horizontal angle with respect to each other.

4. The device of claim 1 wherein the flag means comprises a rigid member of visibly colored polymeric plastic.

5. The device of claim 1 wherein the flag means comprises a rigid member comprising two upright vertical surfaces facing in opposite directions normal to the direction the flag means is indicating, both surfaces being reflective surfaces.

6. The device of claim 1 wherein the attachment means comprises an integral formable metal bracket comprising:

(a) the magnetically attracted member having a centrally positioned plate, (b) a plurality of arms radially extending from the plate, and (c) arm attachment means to fix the arms to the top of the housing of the inboard propeller and steering mechanism or of the outboard motor.

7. A method of docking a boat equipped with an apparatus chosen from a group consisting of an inboard/outboard propeller and steering mechanism and an outboard motor mechanism fixed to a stern of a boat, each mechanism having a thrust vector, the boat comprising a top of a transom at the stern of the boat obscures a line of sight from a piloting position of the boat to an uppermost portion of the inboard/outboard propeller and steering mechanism or of the outboard motor, the method comprising:

(a) reducing the speed of the boat as it approaches the dock, (b) providing a thrust directional guidance device comprising:

(i) an upright member comprising an upper end and a lower end, the upright member being of sufficient length to extend from the lower end of a height proximate housings of the inboard/outboard propeller and steering mechanism or of the outboard motor to an upper end at a height above the transom of the boat, and (ii) flag means fixed to the upper end of the upright member to visually indicate a single direction, (iii) a magnet attached to the lower end of the upright member and a magnetically attracted member attached to the housing of the inboard propeller and steering mechanism or of the outboard motor, (c) releasably attaching the lower end of the upright member to the housing of the inboard propeller and steering mechanism or of the outboard motor, (d) adjusting the single direction indicated by the flag means either in the direction of the thrust vector or in a direction opposite to the thrust vector by horizontal alignment of the magnet into aligning means that provides a preset position of the magnet on the magnetically attracted member, and (e) docking the boat while steering the boat and observing the direction indicated by the flag means to know the direction of the propeller thrust.

8. The method of claim 7 wherein the adjusting comprises fixing the horizontal alignment between lower end of the upright member and the housing of the inboard propeller and steering mechanism or of the outboard motor.

9. The method of claim 7 wherein the providing a thrust direction guidance device further comprises:

(a) providing an integral formable metal bracket comprising:

(i) the magnetically attracted member a centrally positioned plate, and (ii) a plurality of arms radially extending from the plate, (c) forming the arms to align with preexisting bolts through the top of the housing of the inboard propeller and steering mechanism or of the outboard motor, and (d) attaching the arms with the bolts to the top of the housing of the inboard propeller and steering mechanism or of the outboard motor.

* * * * *